United States Patent [19]

Donovan et al.

[11] 3,958,048

[45] May 18, 1976

[54] AQUEOUS SUSPENSIONS FOR SURFACE ACTIVATION OF NONCONDUCTORS FOR ELECTROLESS PLATING

[75] Inventors: Lawrence P. Donovan, Temple City; Eileen Maguire; Leon A. Kadison, both of Pasadena, all of Calif.

[73] Assignee: Crown City Plating Company, El Monte, Calif.

[22] Filed: Apr. 22, 1974

[21] Appl. No.: 462,947

[52] U.S. Cl. ..... 427/304; 106/1; 252/351; 252/352; 252/430; 427/306; 427/437; 427/438

[51] Int. Cl.[2] ..... B05D 3/10; C23C 3/02

[58] Field of Search ..... 117/47 A; 106/1; 252/430, 352, 353; 427/304, 306, 437, 438

[56] References Cited

UNITED STATES PATENTS

| | | | |
|---|---|---|---|
| 3,011,920 | 12/1961 | Shipley | 117/47 A |
| 3,561,995 | 2/1971 | Wu et al. | 117/47 A |
| 3,681,257 | 8/1972 | Levy | 117/47 A |
| 3,772,056 | 11/1973 | Polichehe | 117/47 A |
| 3,790,400 | 2/1974 | Kuzmik | 117/47 A |

OTHER PUBLICATIONS

McCutcheon's Detergents & Emulsifiers, Allowed Publishing Corporation, 1970.

*Primary Examiner*—Ralph S. Kendall
*Assistant Examiner*—John D. Smith
*Attorney, Agent, or Firm*—Christie, Parker & Hale

[57] ABSTRACT

Water soluble salts of metals other than the noble metals, such as copper and nickel salts, are converted in the presence of a water soluble suspending agent to suspensions of water insoluble catalytic particles which are absorbable onto the surface of nonconductors to permit electroless plating of the surfaces.

29 Claims, No Drawings

AQUEOUS SUSPENSIONS FOR SURFACE ACTIVATION OF NONCONDUCTORS FOR ELECTROLESS PLATING

BACKGROUND OF THE INVENTION

The present invention relates to the activation of normally nonconductive surfaces for electroless plating.

Electroless plating is the most important commercial route providing the surface of a nonconductor, such as molded polymers, with a tenacious coat of metal. The important properties of each material are combined. Products may be decorative as well as functional.

In its commercial aspects, an electroless plating operation consists of a number of batchwise operations in series through which articles to be electrolessly plated are passed with rinse operations between each stage. Although residence time will vary from stage to stage, the cycle time for transport apparatus employed requires a degree of coordination of residence time as between the several functional stages involved.

Three principal steps are involved. They are surface etching, surface activation and electroless plating itself. Depending on end use, electroless plating may be and usually is followed by electrolytic plating.

Surface etching involves the immersion of a substrate to be electrolessly plated, i.e. a plastic, into a strong oxidizing acid to etch or "microcraze" the surface to render it porous. This may be preceded by contact with a suitable organic etch to deglaze the surface of the article. A preferred acid etch is that described in U.S. Pat. No. 3,366,130 issued to two of us on June 6, 1972.

Surface activation involves seeding of the porous surface with a metal active to the deposition, through reduction, of a metal contained in the electroless plating bath. To date surface activation, by absorption from aqueous systems has only been possible with the noble metals, e.g. palladium and platinum. The noble metal most typically used is palladium. Seeding is followed by electroless plating using solutions well known in the art. The solutions are typically copper, nickel or cobalt based.

Existing commercial methods of depositing a noble metal involve two distinct stages aside from any rinse operations which may be employed. One method involves contacting the article with a sensitizing solution containing stannous chloride, followed by immersion in an activator solution such as palladium chloride where $Pd^{++}$is reduced to $Pd^{o}$ on the surface of the article Another employs a highly acidic solution of a noble metal colloid, typically a palladium colloid, maintained in suspension by a protective colloid, i.e. stannic acid colloids. Activating solutions of this nature are described in U.S. Pat. No. 3,011,920 to Charles R. Shipley, Jr.

In their preparation, a stannous salt, such as stannous chloride is added in an amount greatly in excess of that required to reduce $Pd^{++}$ to $Pd^{o}$ to contemporaneously form the protective colloid.

Colloidal palladium formed by other reductants and protected by other protective colloids under alkaline conditions are also mentioned. They are, however, stated to be less effective than the acidic colloids and, as presently known, have not been used to any extent.

Because the colloidal palladium as well as the protective colloid are co-absorbed by the substrate to be electrolessly plated, the article is immersed in an acidic or alkaline accelerator solution to remove the protective colloid and expose the absorbed noble metal.

The acceleration step can be eliminated if the electroless plating solution is highly alkaline in nature and capable of removing the protective colloid. This route, however, is not commercially feasible since prolonged immersion times are required before electroless plating begins. This method, therefore, also requires, in substance, two stage activation.

Because of the high cost of noble metals and certain problems attendant to their use, it would be desirable to seed a surface with another material such as the metal contained in the electroless plating bath or one which is receptive to the metal contained in the electroless plating bath.

However, no aqueous solution or dispersion of metals other than the noble metals are presently known to be capable of permitting absorption of metals onto the surface of a nonconductor so as to render the seeded surface catalytically active for electroless plating.

A suggested route has been to finely grind a metal receptive to the metal contained in the electroless plating solution and blend the metal with a resin prior to molding. The basic theory is that the metal will be exposed on the surface of a molded part to permit electroless plating. In addition to being impractical, bond strengths and plate are non-uniform which defeats one requirement of a truly flexible electroless plating operation. That is, the ability to achieve a tenacious coat of metal of sufficient uniformity to permit a subsequent electrolytic plating operation to form a "mirror" finish on an article.

SUMMARY OF THE INVENTION

According to the present invention there is provided aqueous suspensions containing metals other than the noble metals which may be absorbed from the suspension by the surface of nonconductors such as plastics, and which render the surfaces active for electroless plating.

The activator suspensions of this invention are formed by reaction in an aqueous phase of one or more metal ions with a water soluble co-reactant capable to form a water insoluble, catalytically active reaction product which is absorbable in the suspended state as caused by the presence of at least one water soluble organic suspending agent. The suspended reaction product formed is catalytically active with respect to the reduction and deposition of an ionic metal contained in a suitable electroless plating solution independent of the organic dispersing agent present. The insoluble reaction product is, however, because its formation in the presence of the suspending agent, of a particle size sufficiently fine to be absorbed by the porous surface of a substrate to be electrolessly plated.

Although not required, the ionic metals converted to absorbable catalytically active particles may be the same as or known to be catalytically active for the deposition of the metal contained in the electroless plating solution. Typical metals include copper, nickel, iron, cobalt, manganese and the like. Copper and nickel alone or in combination with one or more of the other aforementioned metals are preferred. While not required, one or more noble metals in an active absorbable state may also be present.

The water insoluble reaction products obtained may contain the metal in the free metal state, as part of a complex state or as part of an inorganic insoluble reaction product in its introduced or reduced valence state.

They are maintained suspended by the presence of a water soluble organic suspending agent. The preferred suspending agents are dextrine (water soluble gums and starches), polymerized alkyl napthalene sulfonic acids and their salts, polymerized aryl and substituted benzoid alkyl sulfonic acids and their salts as well as mixtures thereof. It is preferred that a polymerized alkyl napthalene sulfonic acid of its salts be present alone or in admixture with a another dispersing agent.

The suspensions are formed by the addition of a coreactant capable of forming the water insoluble reaction product to the aqueous solution of the ionic metal employed and the suspending agent. The preferred reactants are the hydrides, preferably borohydrides, and most preferably sodium borohydride. The suspensions are jet black in appearance.

Although not essential to the formation of the suspension, pH control is necessary to maintain the suspension in a catalytically active state. If acid in nature, pH should be less than about 5 preferably less than 2.5. If alkaline, pH should be between 7.7 and 9.5, preferably from about 8.0 to about 8.5. Acids or bases providing anions or cations already present in solution are preferably used to adjust, if necessary, pH.

The activator solutions are typically prepared by first dissolving one or more metal salt(s) and a water soluble, organic dispersing agent in water then added followed by the addition of the co-reactant with agitation. Where resultant suspension is non-absorbable because of pH, an acid or base is added to adjust pH.

In general, the activator suspensions contain the metal or metals in an amount from 0.0001 to about 1.5 mols per liter, suspending agent in an amount from about 0.25 to about 100 grams per liter, the balance being predominently water.

In employing the activator suspensions of this invention, the article to be electrolessly plated is immersed in the activator suspension for a time sufficient for the contained catalytic particles to be absorbed from the suspension onto the surface of the article. Residence time will vary widely and generally from about 1 to about 4 minutes or more, at temperatures ranging from ambient to about 140°F, preferably from about 100° to about 140°F.

Activation at elevated temperatures increases absorption rate and provides the unique feature of the ability to evaporate a portion of the water from the suspension during use to account for water introduced from previous rinse operation(s), and to permit the addition of makeup chemicals, as chemicals are consumed without creating a problem of volume growth.

The most important feature of this invention is that the activator suspensions of this invention do not require the presence of the noble metals, e.g. palladium or platinum to permit electroless plating. As a result, the cost of activation without sacrificing quality can be reduced to only a fraction of the cost of surface activation where the noble metals need be employed.

DETAILED DESCRIPTION

There is provided in accordance with the present invention one stage aqueous activator suspensions which render, upon immersion, a nonconductive surface active for the electroless deposition of metals, such as copper, nickel, cobalt and the like.

The aqueous activator suspensions are prepared by the reaction of one or more metal ions, such as copper, nickel, iron, cobalt, manganese and the like, as well as mixtures thereof, in the presence of one or more water soluble organic suspending agent(s), with a co-reactant, such as a borohydride, to form water insoluble, absorbable particles containing the metal. Although noble metals may be present, they are not required since the absorbable particles are, when absorbed active for the spontaneous reduction and plating of metals electrolessly from conventional electroless plating solutions.

To enable absorption of catalytically active particles by a nonconducting surface requires that the activator suspensions of this invention be maintained, if acidic, at a pH below about 5.0, preferably below about 3.5, or if alkaline at a pH from about 7.7 to about 9.5 preferably about 8.0 to about 8.5.

While functional at ambient temperatures, activation is preferably at a temperature from about 100° to about 140°F, as elevated temperatures enhance the rate of absorption. Mechanical and/or air agitation can be conveniently employed.

The activator suspensions provided in accordance with the invention, are prepared by dissolving one or more metal salts, such as cupric salts, nickel salts, ferric salts, cobalt salts, manganese salts and the like or mixtures thereof, in water along with a water soluble dispersing agent followed by the addition of a water soluble co-reactant.

The co-reactant serves to cause the formation of a water insoluble catalytically active reaction product. By the term "catalytically active reaction product" as used herein, there is meant one which will electrolessly plate one or more metals contained in an electroless plating solution capable of plating on a noble metal catalyzed surface. The metal may be the same as or different from the metal contained in the electroless plating solution and preferably known to be catalytic towards its spontaneous reduction to the free metal state. The presently preferred metals are copper, nickel, iron, cobalt, manganese and the like, as well as mixtures thereof.

The insoluble catalytic reaction product may contain the metal in the free metal state, as part of a complex or as a compound in which the valence state is unchanged or has been reduced.

Although any co-reactant capable of forming the desired end product, typically with evolution of hydrogen, may be used, the presently preferred co-reactants are the hydrides. Among the hydrides there may be mentioned the borohydrides, lithium borohydride, potassium diborane, sodium borohydride, dimethyl amine borane and the like. Sodium borohydride is particularly preferred. The catalytically active reaction products formed from sodium borohydride are black. A reaction product which is not black has been fouond to be substantially inactive.

While not bound by theory, it is presently believed the catalytically active insoluble reaction products formed from sodium borohydride are a metal complex. Where copper is the metal, for instance, there is a quantitative suggestion the reaction product contains about 3 mols of copper per mol of boron.

Essential to the formation of the active suspensions of this invention, is the presence of one or more organic dispersing agents when the insoluble particulate reaction product is formed. Among the dispersing agents there may be mentioned the polymerized alkyl napthalene sulfonic acids and alkali metal salts thereof, the polymerized aryl and substituted benzoid alkyl sulfonic acids and the alkali metal salts thereof, dextrin (gums and starches), polysorate mono-oleate, polyvinyl alcohol, gelatin and the like as well as mixtures thereof. It is preferred that a polymerized alkyl napthalene sulfonic acid or salts there be present alone or in admixture with another dispersing agent.

While not bound by the theory, the suspensions of this invention contain suspended catalytically active particles, formed by the condensation of smaller particles, resulting from the reactions which occur, into larger ones which are prevented by the suspending agent from condensing into particles of a size which will not be absorbed onto the surface of a substrate to be electrolessly plated. They are distinguished from dispersions which result from the breakdown of larger particles into smaller particles.

When formed from sodium borohydride, reaction preferably occurs under alkaline conditions. In this instance, alkaline conditions are created by the addition of the sodium borohydride in the presence of a base such as sodium hydroxide. The formed suspension may be used as such if sufficiently alkaline. If necessary, a base can be added to adjust pH to the desired range. If acidic conditions are desired an acid such as hydrochloric acid may be added to revert the formed suspension to the acidic state.

Suspension stabilizers such as polyethylene glycol having an average molecular weight of a bout 600 or more may be present.

The preferred concentration of unsoluble suspended metal(s) is from about 0.0001 to about 1.5 mols per liter in order that absorption of the particles onto the surface of a substrate will be rapid and uniform.

The amount of suspending agent added need only be that required to maintain the suspension and will generally range from about 0.25 to about 100 grams per liter.

While no wise limiting, the formed activator suspension of the present invention will generally contain from about 0.0001 to about 1.5 mols per liter of the particulate catalytically active reaction product, from about 0.25 to about 100 grams per liter of the water soluble suspending agent. The particulate, catalytically active reaction product is preferably formed from the corresponding salts of the metals by the addition of the co-reactant in an amount sufficient to provide an activate suspension, and preferably when the co-reactant is sodium borohydride, at least about an equimolar quantity based on the amount of convertible metals present. The balance of the suspension is predominently water. The presently preferred suspensions are copper based and preferably a mixture of copper and nickel salts.

Although functional for the surface activation of any suitable substrate, the use of the metal suspensions of this invention will be described with reference to the activation of polymeric substrates. After etching wth an oxidizing acid such as chromic acid or mixtures of chromic and sulfuric acids, the articles are rinsed, neutralized to remove, to the extent possible, any residual acid then rinsed again. The articles are then immersed in the activator suspension. Depending on the temperatures employed, immersion times may be as low as about 30 seconds and up to as long as desired. For most instances, immersion times of from about 1 to 4 minutes are employed. Although ambient temperatures may be employed, it is preferred that the temperature be from about 100° to about 140°F. as elevated temperatures have been found to minimize immersion time.

Elevated temperatures are also preferably employed to evaporate the water introduced from previous rinse operations and account for excess water resulting from consumption of chemicals so that there will not be created a "growth" factor. This permits makeup chemicals to be added without removing and discarding a portion of the activator solution.

Following immersion of the article to be electrolessly plated in the activator solution, the articles are then water rinsed and immersed in an electroless plating solution. Typical are those based on copper and nickel. Copper solutions are normally used and a typical aqueous composition is given below.

| Ingredient | Molar Concentration |
|---|---|
| Soluble Cupric Salt | 0.02–0.15 |
| Complexing Agent | 0.03–0.75 |
| Reducing Agent | 0.05–1.50 |
| pH Adjustor | Sufficient to give a pH from 11 to 14 |

Solutions are usually stabilized to prevent premature decomposition.

As indicated, the activator suspensions of this invention are useful for surface activation without the need for the presence of the noble metals, i.e. platinum, palladium, gold, silver and the like.

More significant, however, is cost. As compared to noble metal based activator systems cost is only from about 1 to 10% of the present cost of surface activation.

While no wise limiting, the following Examples are illustrative of the practice of the present invention.

EXAMPLES I TO VIII

As a stock solution there was prepared a 0.1 M solution of sodium borohydride by dissolving sodium borohydride in a 0.1 M sodium hydroxide solution. In each of the following Examples, the solution was added dropwise to a well agitated solution of the selected metal salts and the dissolved suspending agent until reaction was complete as evidenced by termination of gas evolution and the presence of a black suspension. In Example IV initial pH was 7.84 and adjusted to a pH of 8 with addition of sodium hydroxide. In Example VIII, solution of the prepared pH showed good surface absorption. When pH was adjusted to 1.26 by hydrochloric acid addition (Example VIII) surface absorption was materially improved.

In each instance a degreased plaque molded from a plating grade of an acrylonitrile-butadiene-styrene resin known as Cyclolac EP-3510 manufactured as sold by the Marbon Division of Borg Warner Corporation was immersed in a chromic acid etch solution prepared according to U.S. Pat. 3,366,130. The etch solution was maintained at a temperature of 150°–155°F. Immersion time was 6 to 7 minutes. Following a water rinse, the plaques were then immersed in the suspensions described in the Examples for periods of time ranging from 2 to 4 minutes.

The plaques were water rinsed and then immersed in an electroless copper plating solution known as Cuposit™ PM-990 manufactured and sold by the Shipley Company. Immersion times were from 6 to 15 minutes and until a uniform bright deposit of copper was formed.

The compositions employed, immersion times and solution temperatures are shown in Table I.

Table I

| Component | Example I | II | III | IV | V | VI | VII | VIII |
|---|---|---|---|---|---|---|---|---|
| | Concentration g/l | | | | | | | |
| Metal Salt | | | | | | | | |
| Cupric Glutonate | 0.80 | | | | | | | |
| Cupric Acetate (1 $H_2O$) | | 0.7 | | | | | | |
| Cupric Sulfate (5 $H_2O$) | | | 2.22 | 2.22 | 2.22 | 2.22 | | |
| Cupric Chloride (2 $H_2O$) | | | | | | | 2.25 | 2.25 |
| Nickel Sulfate (6 $H_2O$) | | | 1.33 | | | | 1.49 | 1.49 |
| Nickel Chloride (6 $H_2O$) | | | | | | | | |
| Cobalt Sulfate (7 $H_2O$) | | | | | 2.54 | | | |
| Ferrous Sulfate (7 $H_2O$) | | | | 3.11 | | | | |
| Manganous Sulfate (1 $H_2O$) | | | | | | 2.54 | | |
| Dispersing Agent | | | | | | | | |
| Daxad-11[1] | 6.67 | 6.67 | 6.67 | 6.67 | 6.67 | 6.67 | 6.67 | 6.67 |
| Daxad-23[2] | | | 1.67 | 1.67 | 1.67 | 1.67 | 1.67 | 1.67 |
| Dextrine[3] | | 3.3 | | | | | | |
| Sodium Borohydride | 0.62 | 0.1 | 0.12 | 0.16 | 0.335 | To a pH of 8.0 | 0.42 | 0.42 |
| pH | 8.6 | 8.25 | 8.0 | 8.0 | 8.09 | 8.0 | 8.0 | 1.26 |
| Immersion Time (min) | 4 | 4 | 4 | 4 | 4 | 4 | 4 | 4 |
| Temperature °F | 98 | 130 | 130 | R.T.[4] | 120 | 100 | RT | RT |
| Absorption | Fair | Good | Good | Good | Good | Good | Very Good | Very Good |

Footnotes:
[1]Daxad 11 — a sodium salt of polymerized alkyl napthalene sulfonic acids manufactured and sold by W. R. Grace and Co.
[2]Daxad 23 — a sodium salt of polymerized aryl and substituted benzoid alkyl sulfonic acids manufactured and sold by W. R. Grace and Co.
[3]Dextrine — a water soluble dispersing manufactured by the Braun Chemical Co.
[4]R.T. = Room Temperature

What is claimed is:

1. An activator suspension for the one stage surface activation of a nonconductive surface for electroless plating which comprises an aqueous suspension of water insoluble particles catalytically active for the reduction and deposition of metal ions contained in an electroless plating solution and formed by an aqueous phase reaction of at least one ionic non-noble metal with a water soluble co-reactant which is a hydride capable of forming the catalytically active water insoluble particles upon reaction with said basic non-noble metals in the presence of at least one water soluble organic suspending agent for said water insoluble particles, the water insoluble particles in said suspension being of a particle size sufficiently small to be absorbable onto the surface of a nonconductive substrate to activate the surface for electroless plating when said suspension is at a pH below about 5.0 and between about 7.7 and about 9.5.

2. An activator suspension as claimed in claim 1 in which pH is from about 8.0 to about 8.5.

3. An activator suspension as claimed in claim 1 in which the water soluble co-reactant is sodium borohydride.

4. An activator suspension as claimed in claim 2 in which the water soluble co-reactant is sodium borohydride.

5. An activator suspension as claimed in claim 1 in which the water soluble suspending agent is selected from the group consisting of polymerized alkyl napthalene sulfonic acids, salts of polymerized alkyl napthalene sulfonic acids and mixtures thereof.

6. An activator suspension as claimed in claim 1 in which the water soluble suspending agent is selected from the group consisting of dextrin, a polymerized aryl sulfonic acid, a salt of a polymerized aryl sulfonic acid, a polymerized substituted benzoid alkyl sulfonic acid, salts of a substituted benzoid alkyl sulfonic acid and mixtures thereof.

7. An activator suspension as claimed in claim 4 in which the water soluble suspending agent is selected from the group consisting of polymerized alkyl napthalene sulfonic acids, salts of polymerized alkyl napthalene sulfonic acids and mixtures thereof.

8. An activator suspension as claimed in claim 4 in which the water soluble suspending agent is selected from the group consisting of dextrin, a polymerized aryl sulfonic acid, a salt of a polymerized aryl sulfonic acid, a polymerized substituted benzoid alkyl sulfonic acid, salts of a substituted benzoid alkyl sulfonic acid and mixtures thereof.

9. An activator suspension as claimed in claim 1 in which the non-noble metal is present in an amount of from about 0.001 to 1.5 mols per liter and the water soluble organic suspending agent is present in an amount of from about 0.25 to 100 grams per liter.

10. An activator suspension as claimed in claim 1 in which the non-noble metal is copper.

11. An activator suspension as claimed in claim 1 in which the non-noble metal is nickel.

12. An activator suspension for the surface activation of a nonconductive surface for electroless plating which comprises an aqueous suspension of water insoluble particles catalytically active for the reduction and deposition of metal ions contained in an electroless plating solution and formed by an aqueous phase reaction of at least one ionic non-noble metal selected from the group consisting of copper, nickel, iron, cobalt, manganese and mixtures thereof, with a water soluble co-reactant which is a hydride capable of forming the catalytically active water insoluble particles upon reaction with said ionic non-noble metal in the presence of at least one water soluble organic suspending agent for the water insoluble particles, the water insoluble particles in said suspension being of a particle size sufficiently small to be absorbable onto the surface of a nonconductive substrate to activate the surface for electroless plating when said suspension is at a pH below about 5.0 and from about 7.7 to about 9.5.

13. An activator suspension as claimed in claim 12 in which the pH is from about 8.0 to about 8.5.

14. An activator suspension as claimed in claim 13 in which the water soluble co-reactant is sodium borohydride.

15. An activator suspension as claimed in claim 12 in which the water soluble co-reactant is sodium borohydride.

16. An activator suspension as claimed in claim 12 in which the water soluble suspending agent is selected from the group consisting of polymerized alkyl naphthalene sulfonic acids, salts of polymerized alkyl naphthalene sulfonic acids and mixtures thereof.

17. An activator suspension as claimed in claim 12 in which the water soluble suspending agent is selected from the group consisting of dextrin, a polymerized aryl sulfonic acid, a salt of a polymerized aryl sulfonic acid, a polymerized substituted benzoid alkyl sulfonic acid, salts of a substituted benzoid alkyl sulfonic acid and mixtures thereof.

18. An activator suspension as claimed in claim 15 in which the water soluble suspending agent is selected from the group consisting of polymerized alkyl naphthalene sulfonic acids, salts of polymerized alkyl naphthalene sulfonic acids and mixtures thereof.

19. An activator suspension as claimed in claim 15 in which the water soluble suspending agent is selected from the group consisting of dextrin, a polymerized aryl sulfonic acid, a salt of a polymerized aryl sulfonic acid, a polymerized substituted benzoid alkyl sulfonic acid, salts of a substituted benzoid alkyl sulfonic acid and mixtures thereof.

20. An activator suspension as claimed in claim 12 in which the non-noble metal is present in an amount of from about 0.0001 to about 1.5 mols per liter andn the water soluble organic suspending agent is present in an amount of from about 0.25 to about 100 grams per liter.

21. A process for the surface activation of nonconductive substrates for electroless plating which comprises immersing the article in an aqueous suspension maintained at a pH less than about 5 or between about 7.5 and 9.5 and containing catalytically active, water insoluble, absorbable particles formed by an aqueous phase reaction of at least one ionic non-noble metal with a water soluble co-reactant which is a hydride in the presence of a water soluble, organic suspending agent for said catalytically active, water insoluble particles for a time sufficient to form an absorbed coating of the water insoluble particles on the surface of the substrate to be electrolessly plated.

22. A process as claimed in claim 21 in which immersion time is for about 1 to about 4 minutes.

23. A process as claimed in claim 21 in which the suspension is maintained at a temperature from ambient to about 140°F.

24. A process as claimed in claim 21 in which the suspension is maintained at a pH less than about 8 to about 8.5.

25. A process as claimed in claim 24 in which the water soluble co-reactant is sodium borohydride.

26. A process as claimed in claim 21 in which the non-noble metal is selected from the group consisting of copper, nickel, iron, cobalt, manganese and mixtures thereof.

27. A process as claimed in claim 21 in which the water soluble co-reactant is sodium borohydride.

28. A process as claimed in claim 21 in which the water soluble suspending agent is selected from the group consisting of polymerized alkyl naphthalene sulfonic acids, salts of polymerized alkyl naphthalene sulfonic acids and mixtures thereof.

29. A process as claimed in claim 21 in which the water soluble suspending agent is selected from the group consisting of dextrin, a polymerized aryl sulfonic acid, a salt of a polymerized aryl sulfonic acid, a polymerized substituted benzoid alkyl sulfonic acid, salts of a substituted benzoid alkyl sulfonic acid and mixtures thereof.

* * * * *